US009194653B1

(12) United States Patent
Jenkinson et al.

(10) Patent No.: US 9,194,653 B1
(45) Date of Patent: Nov. 24, 2015

(54) TRIGGER GUARD TOOL

(71) Applicants: Mark E Jenkinson, Wilbraham, MA (US); Frederick J Holmes, Wilbraham, MA (US)

(72) Inventors: Mark E Jenkinson, Wilbraham, MA (US); Frederick J Holmes, Wilbraham, MA (US)

(73) Assignee: Present Arms, Inc., Wilbraham, MA (US)

( * ) Notice: Subject to any disclaimer, the term of this patent is extended or adjusted under 35 U.S.C. 154(b) by 0 days.

(21) Appl. No.: 14/569,696

(22) Filed: Dec. 13, 2014

(51) Int. Cl.
*F41C 27/00* (2006.01)

(52) U.S. Cl.
CPC ..... *F41C 27/00* (2013.01)

(58) Field of Classification Search
CPC ..... F41A 11/00; F41A 35/00; F41C 27/00
USPC ..... 42/90, 106, 108
See application file for complete search history.

(56) References Cited

U.S. PATENT DOCUMENTS 5,261,136 A * 11/1993 Hall ..... F41C 27/00 42/90
7,240,450 B2 * 7/2007 Shober ..... F41C 27/00 42/108
7,401,432 B2 * 7/2008 Perry ..... F41A 11/00 42/108
2006/0053674 A1 * 3/2006 Shober ..... F41C 27/00 42/108
2006/0260170 A1 * 11/2006 Perry ..... F41A 11/00 42/108
2012/0291330 A1 * 11/2012 Johnson ..... F41A 11/00 42/108
2013/0318850 A1 * 12/2013 Holmes ..... F41A 23/18 42/90

OTHER PUBLICATIONS

Brownells AR-15 Front Sight Bench Block, https://web.archive.org/web/20121024055922/http://www.brownells.com/gunsmith-tools-supplies/rifle-tools/sight-tools/ar-15-front-sight-bench-block-prod20727.asp, Oct. 24, 2012.*
R Guns AR 15 Lower Receiveer / Barrel Assembly Block, https://www.youtube.com/watch?v=a5YQyeg8oA0 , Jun. 10, 2014.*

* cited by examiner

*Primary Examiner* — Joshua Freeman
(74) *Attorney, Agent, or Firm* — Antero & Tormey; Pete Tormey; Mike Petrin

(57) ABSTRACT

A tool providing a means to safely extract and/or insert a roll pin from the trigger guard assembly of a lower receiver unit of an automatic or semiautomatic rifle. Current tools fail to provide positive engagement and support of the trigger guard region, particularly the trigger guard lips which can easily be snapped or fractured during a roll pin extraction or insertion process. Accordingly, the present disclosure provides an improved means to align and support a lower receiver unit by means of complementary mating and stop regions that secure the lower receiver in position while providing one or more cutouts that accommodate protruding levers and buttons on the lower receiver. Some embodiments feature a contoured top section having at least one of a plurality of surface features selected from a cutout, a mating region and a stop region; and a roll pin receiving port.

16 Claims, 6 Drawing Sheets

TRIGGER GUARD TOOL

PRIORITY

This application claims the benefit of the priority of the following United States patent applications, U.S. Provisional application No. 61/689,099, filed on May 30, 2012, and U.S. Utility application Ser. No. 13/897,389 (also published as US 2013/0318850A1), filed on May 18, 2013, both of which are incorporated in their entirety by reference herein.

BACKGROUND

The present invention relates generally to tools for maintenance and repair of firearms, and more particularly to an improved tool for the assembly and disassembly of a trigger guard for a semiautomatic or automatic firearm.

Certain automatic and semiautomatic firearms such as the AR-15 rifle have removable and/or replaceable trigger guards, enabling repair, replacement and substitution with new or replacement parts, the trigger guard typically being held in place by at least one removable and/or resettable pin. For example, the AR-15 rifle has a trigger guard assembly held in place by a forward detent spring pin and a rearward trigger guard pivot pin (also known as a guard roll pin or roll pin) which is typically removed by laying the lower receiver unit of the rifle upon a flat surface or in held in a vice, and then using a hammer and pin removal tool such as a roll pin punch. A punch is a common pin removal tool generally in the form of an flat faced extended uniform cylindrical rod of some hardened metal and a handle, the rod having the same or a slightly smaller diameter than the expanded roll pin or that of the interior diameter of the bore hole in which the roll pin is set. To remove a pin, the roll pin punch tool is placed against the end of the roll pin and the tool positioned to be coaxially aligned with the long axis of the roll pin, so that tapping on the handle end of the tool with a weight or hammer acts to move and dislodged the roll pin from the bore hole in the opposite direction of the roll pin punch and applied force. However, despite an operator taking due care in the placement and orientation of the roll pin punch, it is difficult to maintain a perfect orientation as pressure and/or tapping of the roll pin punch is applied, the result being oblique and lateral forces in addition to the main coaxial (downward typically) force applied to the trigger guard assembly during a roll pin removal process. Despite improvements to roll pin punches, such as the Brownells Roll Pin Punch (Model #230-112-105WB, available from Brownells Inc., 200 South Front Street, Montezuma, Iowa 50171, U.S.A.) which features a small raised projection in the face of the punch that automatically centers the punch and prevents the roll pin from collapsing, the coaxial downward force is still frictionally transferred to the trigger guard assembly, putting unnecessary stress on the trigger guard and the two trigger guard pin joints and surrounding structures. The AR-15 rear trigger guard pin joints are particularly susceptible to bending and/or breakage if excessive force is applied to them, and warping out of alignment with only moderately applied lateral force during roll pin removal. The pin joints are molded into the lower receiver body, so that the functioning of the lower receiver can be compromised if they are distorted, broken off, and/or weakened by bending during a typical pin removal and/or replacement operation.

Various clamps and vice-like devices are conventionally used to hold the lower receiver to facilitate disassembly and pin removal and/or replacement operations. However, those that are commercially available typically only clamp a portion of the lower receiver and do not support the trigger guard components or other susceptible sections of a rifle that can be bent and damaged during disassembly.

Accordingly there is a need for a better device to assist in the maintenance of firearms in order to facilitate damage-free removal and replacement of roll pins at component junctions, such as the trigger guard receiver lips that are susceptible to damage due to forces applied during removal from and insertion of a roll pin into a receiving body or section of a firearm to secure or remove the trigger guard.

SUMMARY

Disclosed herein is a device comprising a platform in the form of a cylinder having a cylindrical base section and a contoured top section; wherein the top surface of the top section is contoured in a three-dimension pattern enabling it to engage with at least one complementary surface portion of a lower receiver unit of a firearm comprising a pistol grip mating region; and further having a roll pin receiving port positioned on the top surface of a trigger guard mating region. The pistol grip mating region services to engage the lower receiver pistol grip area of a firearm to be serviced and hold the lower receiver in a fixed and stable position by means of the complementary frictional and interferential engagement of its surface with the contoured surfaces of the gunner's platform. The roll pin receiving port receives the trigger guard retention pin upon relative movement of the pin when ejected from the lower receiver trigger guard and received by the pin receiving means. In one embodiment, the roll pin receiving port roll pin receiving port is a vacant space or cutout region located on the surface of the device and of sufficient diameter and depth so as to receive the roll pin after ejection without binding or hindering it's motion during the ejection process. It is preferred that the roll pin receiving port does not undermine the support of the trigger guard section of the weapon during ejection, and so should not greatly exceed the size of the lower (and upper) trigger guard lips, so that the lower trigger guard lip remains supported during pin ejection. In another embodiment, the roll pin receiving port is a bore hole sized sufficiently so as to be able to receive the roll pin during the displacement process and following complete ejection of the roll pin from the weapon being serviced.

In one embodiment, the trigger guard engaging means mates with the trigger guard section of a lower receiver unit, for example the AR-15 rifle, to support the trigger guard section during roll pin removal. In another embodiment, the top section further features a pistol grip mating region that has a surface contour that mates in a complementary fashion with the lower receiver pistol grip to hold the lower receiver in position without moving or flexing during the roll pin removal and/or insertion process.

In another embodiment of the device, the gunners platform is used in a method to eject and/or to insert a roll pin into the lower receiver unit of a firearm by means of supporting the trigger guard region of said lower receiver using a combination of: a pistol grip mating region and a roll pin receiving port; which serve to secure and hold the lower receiver in position by engaging the corresponding pistol grip region of the lower receiver; and by receiving an ejected roll pin from the trigger guard after ejection, respectively.

Additional embodiments of the gunners platform include one or more additional cutout regions on the upper surface of the device to provide clearance for protruding features on the lower receiver when it is engaged with the device, such as for example, but not limited to: a safety/selector switch, a safety lever, and a magazine release catch button; said cutout regions, respectively, being one of a safety/selector switch cutout, a safety lever cutout, and a magazine release catch cutout.

Additional embodiments of the gunners platform include one or more additional stop regions on the upper surface of the device to provide an interference fit between the lower receiver unit of the firearm and the device, such as for example, but not limited to: the front trigger guard and the upper portion of the lower receiver body; said stop regions, respectively, being one of a front trigger guard stop region and a upper lower receiver body stop region.

Additional embodiments of the gunners platform include one or more additional mating regions on the upper surface of the device which serve to engage one or more corresponding surfaces or regions of the lower receiver unit so as to position and align it properly with respect to the trigger guard mating region and the roll pin receiving port in order that the lower receiver unit remains fixed and stationary when engaged with the device during a roll pin removal procedure. In further embodiments, the one or more mating regions are selected from, but not limited to, a front trigger guard mating region, a trigger guard mating region, a pistol grip mating region, and a center lower receiver body mating region.

In a further embodiment, a the circular base of the gunners platform couples with a region on a weapons servicing and repair station, such as for example, but not limited to, the Gunner's Mount® weapons station (item # GM102 sold by Present Arms, Inc. PO Box 839, Wilbraham, Mass., USA 01095).

Additional embodiments of a include a device featuring at least one or more selected combinations of these exemplary mating regions, stop regions, and cutout regions; in combination with at least one of a pistol grip mating region; and a roll pin receiving port.

In one embodiment, the gunners platform comprises a platform in the form of a right circular cylinder having a planar cylindrical base section and a contoured top section; wherein the top surface of said contoured top section is contoured in a three-dimension pattern enabling it to engage with at least one complementary surface portion of a lower receiver unit of a firearm; a pistol grip mating region; and a roll pin receiving port positioned on said top surface; whereby the roll pin receiving port receives the trigger guard retention roll pin upon relative movement of the roll pin when ejected from the trigger guard and received by the pin receiving means. In another embodiment, the gunners platform has a contoured top section comprising a plurality of planar regions on said top surface of said top section; wherein the surfaces of said planar regions are horizontal and substantially parallel to the flat bottom surface; wherein said plurality of planar regions each extend horizontally to select heights with respect to the bottom surface; and whereby said height of each planar region is selected to render the countered top section operable to engage at least one complementary surface portion of a lower receiver unit of a firearm having a trigger guard.

In yet another embodiment, the gunner's platform comprises a right circular cylinder having a planar cylindrical base section and straight perpendicular walls joining said base section and said contoured top section. The base section can have a flat bottom surface to enable ease of rotation, and optionally can be textured to enable frictional rotation when sufficient rotation force is applied to turn in with respect to a receptive base region or surface upon which it is placed during servicing of a weapon mated to the platform.

In another embodiment, the contoured top surface of the platform features a plurality of planar regions comprising at least two regions selected from a front trigger guard stop region, a front trigger guard mating region, a trigger guard mating region, a pistol grip mating region, a center lower receiver body mating region, an upper lower receiver body stop region, and/or any combination thereof.

In a further embodiment, the contoured top section of the gunners platform comprises at least one cutout selected from a safety/selector cutout, a magazine release catch cutout, a front trigger guard pivot cutout, a safety lever cutout, and/or a combination thereof.

In yet another embodiment, the contoured top section comprises at least one regions selected from a front trigger guard stop region, a front trigger guard mating region, a trigger guard mating region, a pistol grip mating region, a center lower receiver body mating region, an upper lower receiver body stop region, and/or any combination thereof; and a roll pin receiving port.

The contoured top section may, in one embodiment, comprise at least one cutout selected from a safety/selector cutout, a magazine release catch cutout, a front trigger guard pivot cutout, a safety lever cutout, and/or a combination thereof; and a roll pin receiving port.

In one embodiment, the gunners platform comprises a contoured top section comprising at least one cutout and a least one mating region; wherein said cutout is selected from a safety/selector cutout, a magazine release catch cutout, a front trigger guard pivot cutout, and a safety lever cutout; and wherein said mating region is selected from a front trigger guard stop region, a front trigger guard mating region, a trigger guard mating region, a pistol grip mating region, a center lower receiver body mating region, and an upper lower receiver body stop region; and a roll pin receiving port.

In a second embodiment, the gunners platform comprises a contoured top section comprising at least one stop region selected from a front trigger guard stop region and an upper lower receiver body stop region.

In yet a further embodiment, the gunners platform comprises a contoured top section comprising at least one each of a cutout, a mating region and a stop region; and a roll pin receiving port; wherein said cutout is selected from a safety/selector cutout, a magazine release catch cutout, a front trigger guard pivot cutout and a safety lever cutout; wherein said mating region is selected from a front trigger guard mating region, a trigger guard mating region, a pistol grip mating region and a center lower receiver body mating region; and wherein said stop region is selected from a front trigger guard stop region and an upper lower receiver body stop region.

In yet another embodiment, the gunners platform comprises a roll pin receiving port and a roll pin bore stop; wherein said roll pin receiving port is in the form of a hole or bore communicating with said upper contoured surface in a region corresponding to the said pistol grip mating region.

In another embodiment, a pistol grip mating region is configured to receive the lower receiver unit of a weapon by engaging the pistol grip region of said weapon with the pistol grips removed from the weapon.

One embodiment of the present disclosure is a method of using a device to extract a trigger guard roll pin from a lower receiver unit of a weapon comprising the steps of: (a) mating a lower receiver unit onto a device comprising: (i) a platform in the form of a right circular cylinder having a planar cylindrical base section and a contoured top section; wherein the top surface of said contoured top section is contoured in a three-dimension pattern enabling it to engage with at least one complementary surface portion of a lower receiver unit of a firearm; (ii) a pistol grip mating region; and (iii) a roll pin receiving port positioned on said top surface; then (b) causing said roll pin to be ejected from said trigger guard by means of a downward force applied to said roll pin by suitable means; whereby the roll pin receiving port receives the roll pin upon relative movement of the roll pin when ejected from the trigger guard.

Another embodiment of the present disclosure is a method of extracting or inserting a roll pin associated with a lower receiver unit of a weapon by using a gunners platform with a contoured top section comprising at least one each of a cutout, a mating region and a stop region; and a roll pin receiving port; wherein said cutout is selected from a safety/selector cutout, a magazine release catch cutout, a front trigger guard pivot cutout and a safety lever cutout; wherein said mating region is selected from a front trigger guard mating region, a trigger guard mating region, a pistol grip mating region and a center lower receiver body mating region; and wherein said stop region is selected from a front trigger guard stop region and an upper lower receiver body stop region.

Yet another embodiment of the present disclosure is a method of extracting or inserting a roll pin associated with a lower receiver unit of a weapon by of using a gunners platform comprising a planar cylindrical base section in the form of a right circular cylinder having a contoured top section; wherein said base section has a flat bottom surface; and wherein said base section mates with a receptive docking region located on a base platform of a weapons servicing and repair station, such the Gunner's Mount® weapons station item # GM102 sold by Present Arms, Inc. PO Box 839, Wilbraham, Mass., USA 01095.

The construction and method of operation of the invention, however, together with additional objectives and advantages thereof will be best understood from the following description of specific embodiments when read in connection with the accompanying drawings.

DESCRIPTION

Generality of Invention

Figure 1:
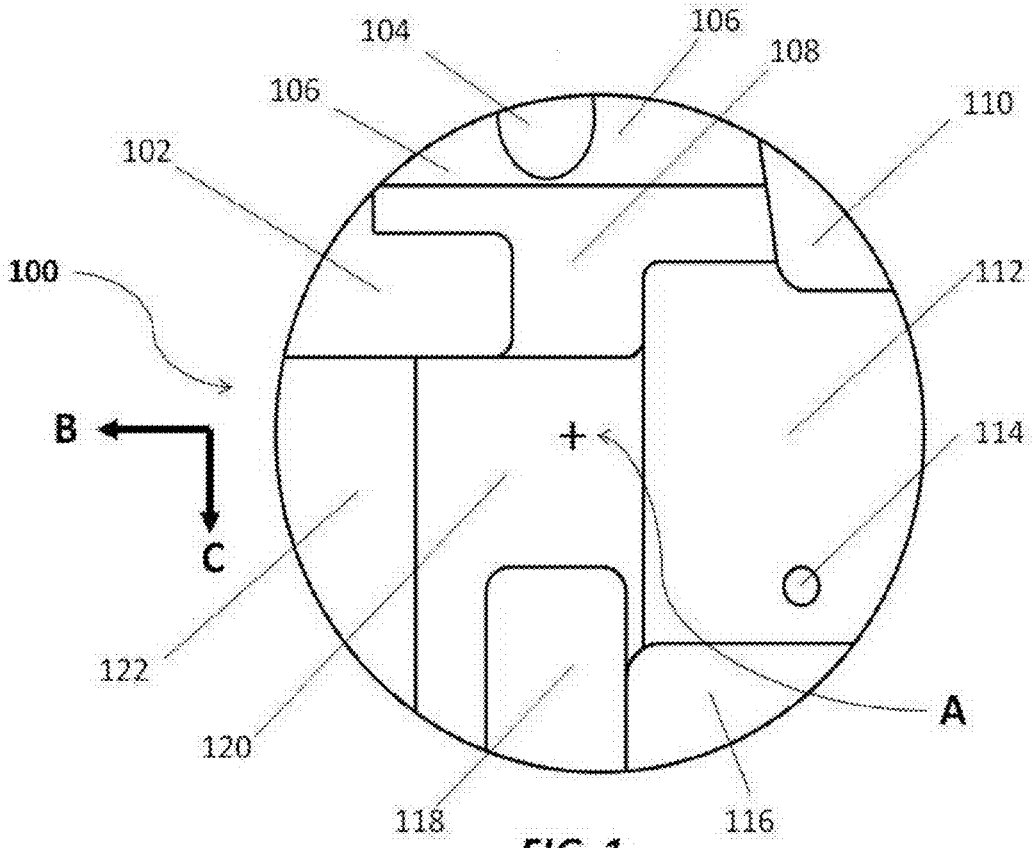
FIG. 1 shows a top view of one embodiment of a gunners platform.

This application should be read in the most general possible form. This includes, without limitation, the following:

References to specific techniques include alternative and more general techniques, especially when discussing aspects of the invention, or how the invention might be made or used.

References to "preferred" techniques generally mean that the inventor contemplates using those techniques, and thinks they are best for the intended application. This does not exclude other techniques for the invention, and does not mean that those techniques are necessarily essential or would be preferred in all circumstances.

References to reasons for using particular techniques do not preclude other reasons or techniques, even if completely contrary, where circumstances would indicate that the stated reasons or techniques are not as applicable.

Furthermore, the invention is in no way limited to the specifics of any particular embodiments and examples disclosed herein. Many other variations are possible which remain within the content, scope and spirit of the invention, and these variations would become clear to those skilled in the art after perusal of this application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Read this application with the following terms and phrases in their most general form. The general meaning of each of these terms or phrases is illustrative, not in any way limiting.

DETAILED DESCRIPTION

FIG. 1 shows one embodiment of the gunners platform 100 having a generally circularly shape in the form of a cylinder with a contoured upper surface featuring a plurality of mating regions on the surface that serve to mate with the corresponding complementary surface(s) of a lower receiver of a weapon placed onto the top surface 101 of the gunners platform 100. In another embodiment, the gunners platform 100 features a trigger guard mating region 112 combined with a pistol grip mating region 116 and a roll pin receiving port 114, being in this embodiment a bore hole located as indicated on the surface of the trigger guard mating region 112 and positioned so as to be able to receive a roll pin ejected from the lower receiver trigger guard portion of a weapon, such as the AR-15 rifle. The roll pin receiving port may in another embodiment be a bore hole with a depth equal to or slightly deeper than the length of the roll pin, so as to substantially receive it in its entirety, or receive it sufficiently that the roll pin can be ejected from the trigger guard unit into the pin receiving bore hole and be flush with the upper surface of the device, or alternatively to extend outward from the upper surface so as to enable retrieval with a pair of tweezers or pliers, yet not extend sufficiently far so as to touch the trigger guard assembly after ejection. In one embodiment, the roll pin receiving port is a bore or hole with a slightly larger dimension than the roll pin outer diameter, featuring a clearance of between about 0.001 inches to about 0.01 inches, or alternatively between 0.005 inches to about 0.05 inch, or yet alternatively between 0.01 inches to about 0.10 inches.

In a further embodiment the gunners platform 100 features additional cutouts and regions located on and/or communicating with the contoured upper surface 101 including a safety/selector cutout 102 which provides clearance for the protruding safety switch and/or selector switch located on the lower receiver of the weapon so that the contoured upper surface 101 can engage said lower receiver without interference, thus forming a close complementary fit. In yet another embodiment, the gunners platform 100 also features a magazine release catch cutout 104 which provides clearance for the protruding magazine release button located on a lower receiver. In a further embodiment, the gunners platform 100 features a front trigger guard stop region 106 which provides a region for engaging the front edge of the trigger guard of a lower receiver, and which is located adjacent to the trigger guard mating region 112. Additional embodiments include a gunners platform 100 with said trigger guard mating region 112 further including a front trigger guard stop region 106, a front trigger guard mating region 108 and a front trigger guard pivot cutout 110. Therein, the said front trigger guard mating region 108 is configured so as to engage the front or leading edge of the trigger guard of a lower receiver, and said front trigger guard pivot cutout 110 provides clearance for the trigger guard, when the pivot pin is ejected, to freely pivot from a 'closed' to 'open' position for servicing or replacing, without requiring the lower receiver of the weapon to be disengaged from the gunners platform 100.

In FIG. 1, the center axis of the gunners platform is indicated as Point A, a reference point around which the platform can freely be rotated to select any desired orientation, particularly with respect to a work station engaging the inventive device.

Figure 2:
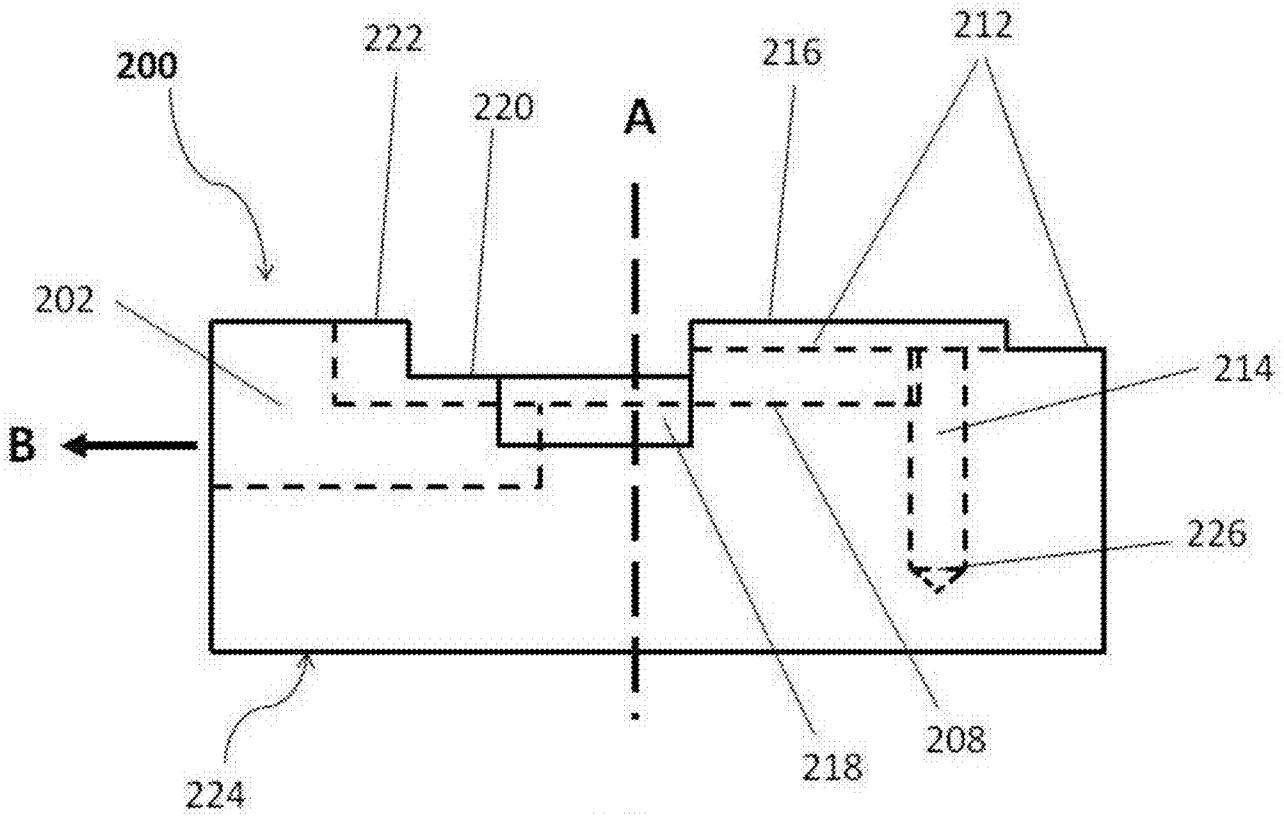
FIG. 2 shows a cross sectional side view of a gunners platform, the side view being that taken by viewing the platform along the "B" axis as shown in FIG. 1.

FIG. 2 shows a cross sectional side view along the "B" axis of the device as shown in FIG. 1, the B axis being parallel to the direction indicated by the arrow. In FIG. 2, one embodiment of the gunners platform 200 is seen to feature a safety/selector cutout 202 whose edges are illustrated as a dotted line that shows one edge continuing to the top surface and one edge continuing to the side of the gunners platform 200 facing in direction B as indicated by the arrow in FIG. 2, said cutout region serving to provide clearance for the protruding safety/selector switch located on the lower receiver unit when mated to the device for servicing. In another embodiment, the gunners platform 200 features an additional safety lever cutout 218 serving to provide clearance for the protruding safety lever button on the lower receiver unit. In another embodiment, the gunners platform features a front trigger guard mating region 208 depicted as a dotted line extending from right to left, having an elevation with respect to the upper contoured surface that is lower than the elevation of the trigger guard mating region 212, and that also is lower than the elevation of the center lower receiver body mating region 220 that extends from the inner edge of the upper lower receiver body stop region 222 to the inner edge of the trigger guard mating region 212. FIG. 2 also illustrates an embodiment of the device having a roll pin receiving port 214 in the form of a bore hole extending from the upper or top surface of the gunners platform 200 located with the trigger guard mating region 212, having a selected width sufficient to hold an ejected roll pin without binding within the confines of the bore hole, and having a roll pin bore stop 226 at a selected depth sufficient to hold the ejected roll pin without its substantially protruding from the bore hole, but wherein the depth enables the roll pin to be easily removed from the bore hole by means of tweezers or simply inverting the entire gunners platform 200 to dislodge the captured roll pin. In another embodiment, as shown in FIG. 2, the gunners platform 200 features a pistol grip mating region 216 and a safety lever cutout 218 to accommodate coupling with the lower receiver pistol grip area of the weapon while providing clearance for the safety level switch located on the lower receiver. The gunners platform 200 also features a smooth, flat bottom face 224 that enables it to rotate freely about the center axis A and to be positioned in combination with, and/or within a receptive region on a weapons servicing and repair station, such as for example, but not limited to, the Gunner's Mount® weapons station (item # GM102 sold by Present Arms, Inc. PO Box 839, Wilbraham, Mass., USA 01095).

Figure 3:
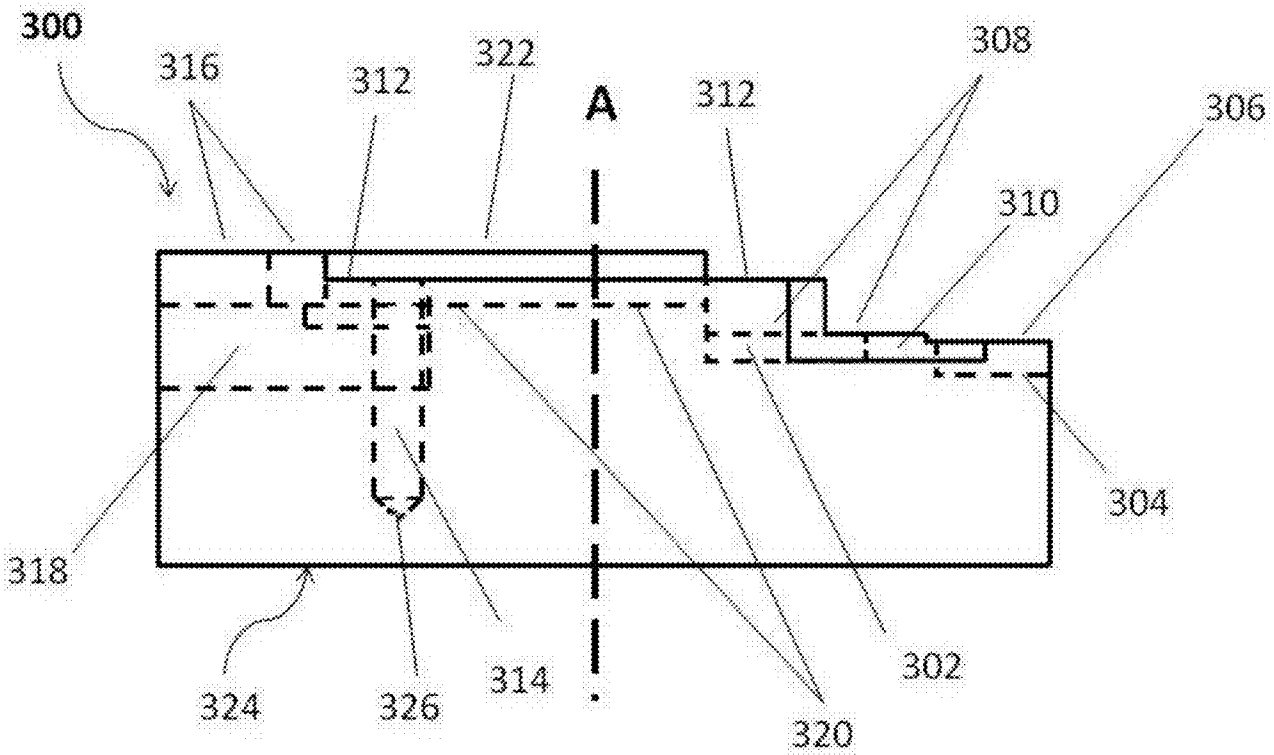
FIG. 3 shows a cross sectional side view of a gunners platform, the side view being that taken by viewing the platform along the "C" axis as shown in FIG. 1.

In another embodiment, FIG. 3 shows a cross sectional side view as seen by viewing along the axis direction denoted as "C" in FIG. 1. Here, the gunners platform 300 features a safety/selector cutout 302, a magazine release catch cutout 302, a front trigger guard stop region 306 in combination with a front trigger guard mating region 308 and a front trigger guard pivot cutout 310 adjacent to a trigger guard mating region 312 located on the top facing surface of the device. FIG. 3 also shows the relative positioning of the roll pin receiving port 314 in relation to the pistol grip mating region 316 and a safety lever cutout 318 located adjacent to a center lower receiver body mating region 320. In this embodiment, the roll pin receiving port 314 is a hole terminated by a roll pin bore stop 326. In FIG. 3, the arrow denoted "B" refers to a direction perpendicular to the lower receiver long axis when the gunners platform is properly aligned with respect to, or when mated with the gunners platform 300.

Figure 4:
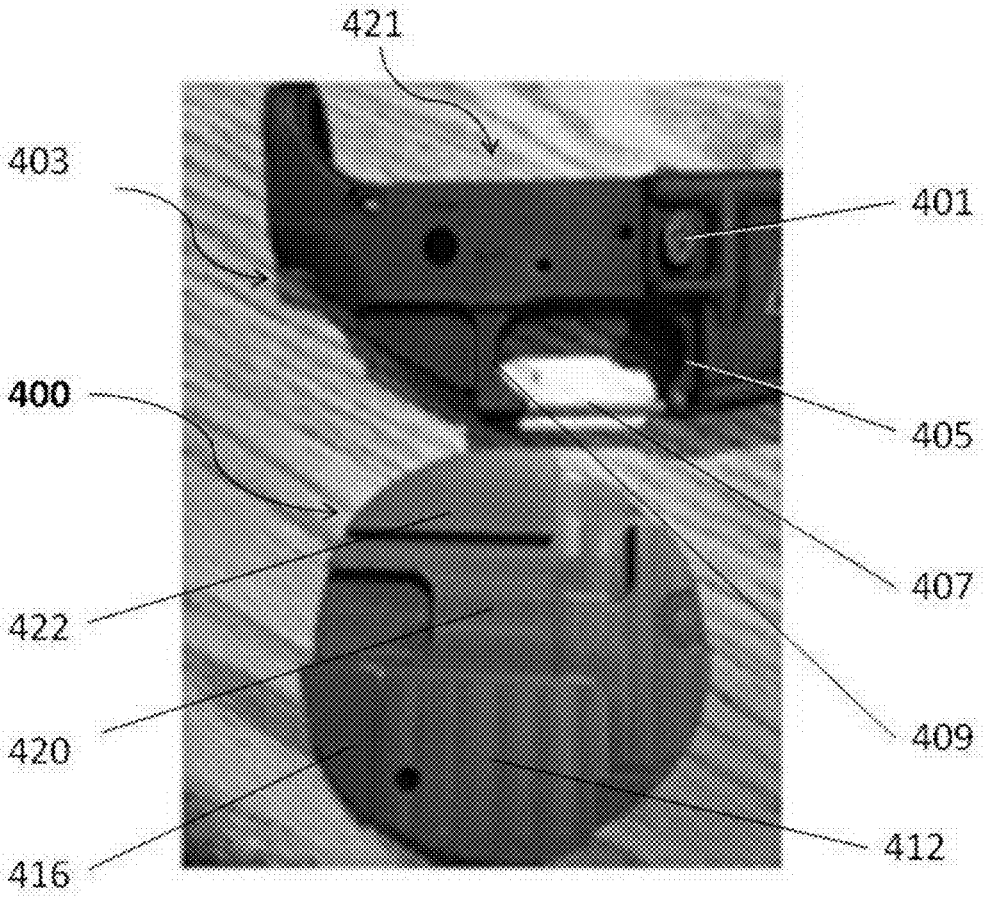
FIG. 4 shows a perspective view of a gunners platform with adjacent AR-15 lower receiver positioned nearby, with the pistol grip handle removed from the receiver.

In yet another embodiment, FIG. 4 shows a top view of a gunners platform 400 with an adjacent AR-15 lower receiver unit 403, shown with the pistol grips (not shown) removed from the lower receiver. In this embodiment, the upper surface of the gunners platform 400 is contoured with a plurality of surface features and indentations selected to complement the surface features of the lower receiver unit 403 to accommodate docking with the device. The lower receiver unit 403 features a magazine release button 401, a front trigger guard section 405 adjacent to the trigger guard 407 and the rear trigger guard section 409. Here, the gunners platform 400 features a trigger guard mating region 412, a pistol grip mating region 416 and a center lower receiver body mating region 420. In another embodiment, the gunners platform 400 also features an upper lower receiver body stop region 422 which mates with the upper surface of lower receiver body 421 to align the lower receiver 403 relative position with respect to the device and insure that the position of the roll pin located on the lower receiver 403 is properly centered over the roll pin receiving port 414 located within and communicating with the surface of the respective trigger guard mating region 412 when the lower receiver 403 is mated to the device.

Figure 5:
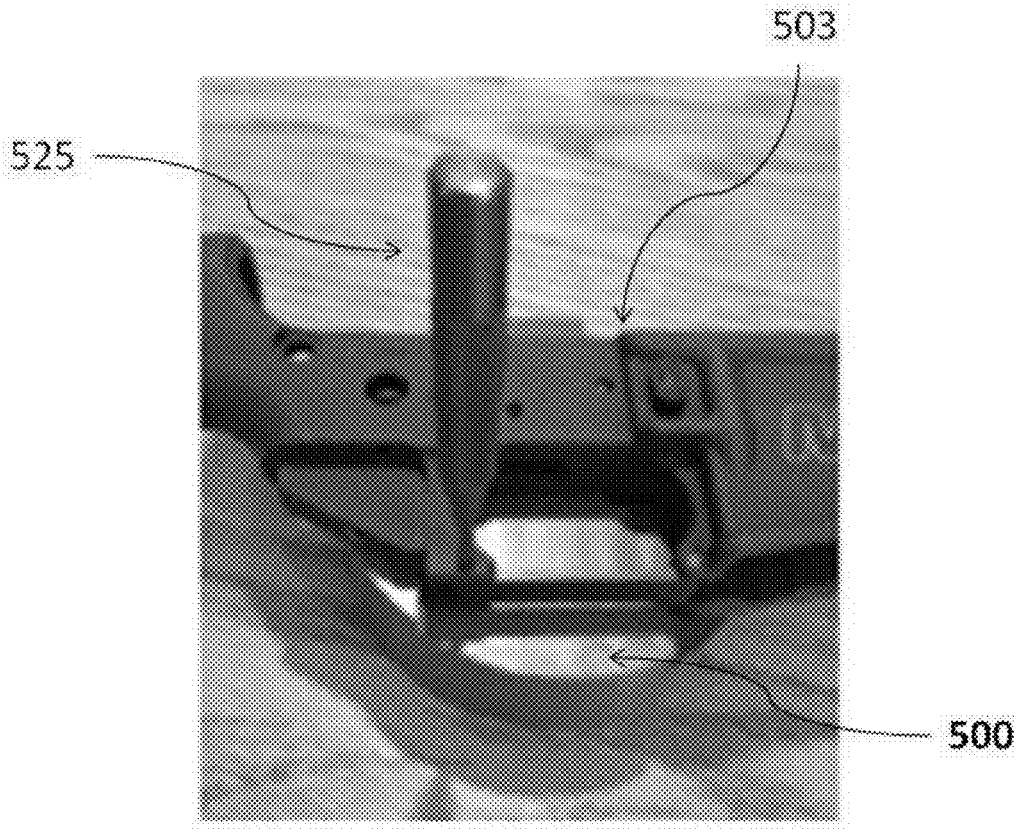
FIG. 5 shows a perspective view of a gunners platform with an AR-15 receiver mated to the top surface of the platform with a pin punch removal tool positioned above the roll pin located in the rear trigger guard section, prior to pin removal.

FIG. 5 shows a top perspective view of an AR-15 lower receiver unit 503 engaged with an embodiment of the gunner's platform 500 with a punch pin removal tool 525 positioned to engage the roll pin located on the lower receiver unit near the rear trigger guard section.

Figure 6:
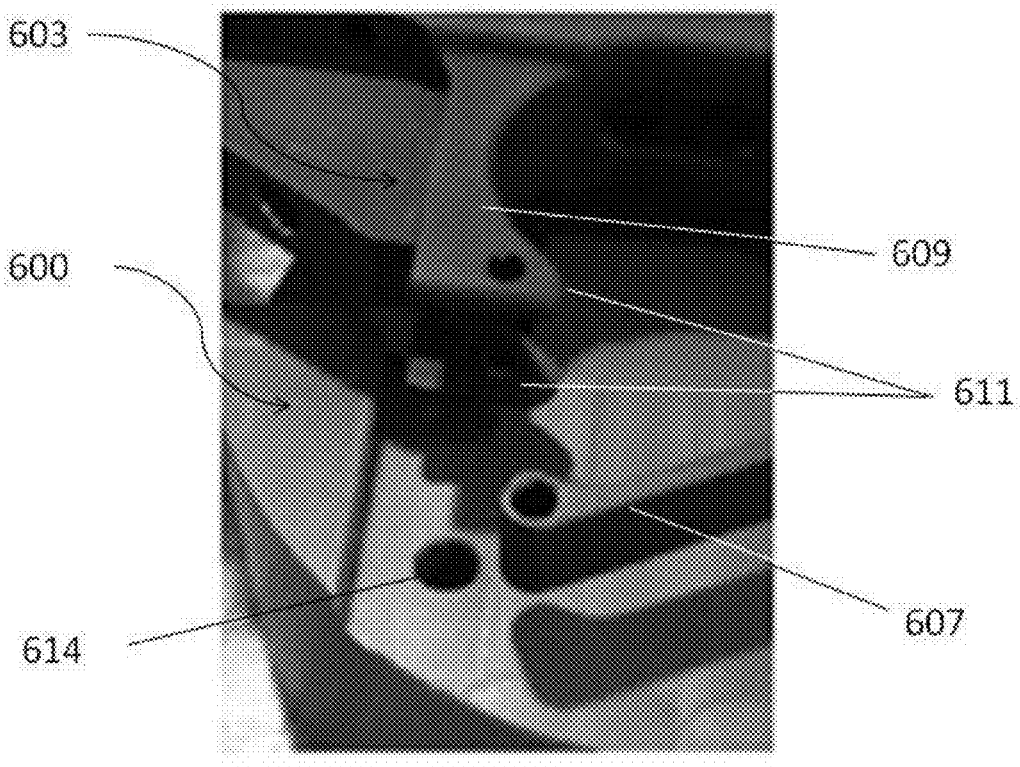
FIG. 6 shows a perspective view of a gunners platform with an unengaged AR-15 receiver with the roll pin removed and trigger guard lever freed from the upper and lower trigger guard lips, and the roll pin recovered from the roll pin receiving port.

FIG. 6 shows a top perspective view of a gunners platform 600 with a displaced (non-mated) AR-15 lower receiver unit 603 with the roll pin (not shown) removed, showing the trigger guard lever 607 pivoted away from the rear trigger guard section 609 after removal of the roll pin has been completed. It can be seen that the upper and lower trigger guard lips 611 are very thin and delicate, and being made from aluminum and/or a light metal alloy, very susceptible to bending and deformation when subjected to lateral forces perpendicular to the axis of the roll pin during extraction and insertion operations of the roll pin into the trigger guard lever 607. Also shown in FIG. 6 is the roll pin receiving port 614 which catches and retains the roll pin after its ejection from the trigger guard lever 697 and the upper and lower trigger guard lips 611.

Thus, referring to FIGS. 4, 5 and 6 in sequence, one can see an illustration of a roll pin extraction and/or removal process starting with positioning of one example embodiment of a gunners platform ready to receive the lower receiver unit with an installed trigger guard in FIG. 4, followed by placement of the lower receiver unit onto the gunners platform in FIG. 5. FIG. 5 shows the positioning of a punch tool over the rear trigger guard section of the lower receiver unit, set to engage the upper face of the roll pin present in the trigger guard section, prior to the application of a downward force to displace and extra the pin, first by clearing the upper trigger guard lip 611, then the trigger guard lever 607 and then finally the lower trigger guard lip 611 to effect complete release of the trigger guard lever 607 from the rear trigger guard section 609, as shown in FIG. 6.

To install or insert a roll pin to resecure the trigger guard lever in proper position within the rear trigger guard section, the same steps may, in one embodiment of an insertion procedure, be performed in essentially the reverse order as that described in the above paragraph exampling an extraction/removal procedure.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

One having skill in the art will recognize that the device 100 may be formed from any suitable material capable of handling repeated usage and handling, the stress of turning a bushing and maintaining a plug in position. This may be including, but not limited to, plastics, metals, polymers, ceramics, alloys, wood, composites, and further including other typical materials of construction used in the tool making industry for construction of tools and devices.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device comprising:

a platform in substantially the form of a right circular cylinder having a substantially planar cylindrical base section and a contoured top section;

wherein said contoured top section is contoured in a three-dimension pattern configured to engage with at least one complementary surface portion of a lower receiver unit of a firearm having a trigger guard;

wherein said top section comprises a plurality of top surfaces comprising:

a pistol grip mating region configured to receive a pistol grip of said firearm; and a roll pin receiving port positioned on said top section;

whereby the roll pin receiving port is configured to receive a trigger guard retention roll pin upon displacement of the roll pin when ejected from said trigger guard.

2. The device of claim 1 wherein said contoured top section comprises a plurality of substantially planar top surfaces on said top section;

wherein the said plurality of top surfaces are substantially horizontal and substantially parallel with respect to a planar surface of the base section;

wherein said plurality of top surfaces each extend horizontally to select individual heights with respect to the base section;

whereby said individual heights of each individual top surface are selected to render the countered top section operable to engage at least one complementary surface portion of a lower receiver unit of a firearm having a trigger guard.

3. The device of claim 1 wherein said platform comprises a right circular cylinder having a substantially planar cylindrical base section and substantially straight perpendicular walls joining said base section and said contoured top section.

4. The device of claim 1 wherein said platform comprises a planar cylindrical base section in the form of a right circular cylinder having a contoured top section;

wherein said base section has a substantially flat bottom surface.

5. The device of claim 1 wherein said plurality of top surfaces on said top section comprises at least two regions selected from a front trigger guard stop region, a front trigger guard mating region, a trigger guard mating region, a pistol grip mating region, a center lower receiver body mating region, an upper lower receiver body stop region, and/or any combination thereof.

6. The device of claim 1 wherein said contoured top section comprises at least one cutout selected from a safety/selector cutout, a magazine release catch cutout, a front trigger guard pivot cutout, a safety lever cutout, and/or a combination thereof.

7. The device of claim 1 wherein said contoured top section comprises at least one region selected from a front trigger guard stop region, a front trigger guard mating region, a trigger guard mating region, a pistol grip mating region, a center lower receiver body mating region, an upper lower receiver body stop region, and/or any combination thereof;

and a roll pin receiving port.

8. The device of claim 1 wherein said contoured top section comprises at least one cutout selected from a safety/selector cutout, a magazine release catch cutout, a front trigger guard pivot cutout, a safety lever cutout, and/or a combination thereof; and a roll pin receiving port.

9. The device of claim 1 wherein said platform comprises a contoured top section comprising at least one cutout, at least one mating region and a roll pin receiving port;

wherein said cutout is selected from a safety/selector cutout, a magazine release catch cutout, a front trigger guard pivot cutout, and a safety lever cutout;

wherein said mating region is selected from a front trigger guard stop region, a front trigger guard mating region, a trigger guard mating region, a pistol grip mating region, a center lower receiver body mating region, and an upper lower receiver body stop region.

10. The device of claim 1 wherein said platform comprises a contoured top section comprising at least one stop region selected from a front trigger guard stop region and an upper lower receiver body stop region.

11. The device of claim 1 wherein said platform comprises a contoured top section comprising at least one each of a cutout, a mating region and a stop region; and a roll pin receiving port;

wherein said cutout is selected from a safety/selector cutout, a magazine release catch cutout, a front trigger guard pivot cutout and a safety lever cutout;

wherein said mating region is selected from a front trigger guard mating region, a trigger guard mating region, a pistol grip mating region and a center lower receiver body mating region; and wherein said stop region is selected from a front trigger guard stop region and an upper lower receiver body stop region.

12. The device of claim 1 wherein said roll pin receiving port comprises a roll pin bore stop; wherein said roll pin receiving port is substantially in the form of a hole or bore communicating with said upper contoured surface in a region corresponding to the said pistol grip mating region.

13. The device of claim 1 wherein said pistol grip mating region is configured to receive the lower receiver unit of a weapon by engaging the pistol grip region of said weapon with the pistol grips removed from the weapon.

14. A method of using a device to extract a trigger guard roll pin from a lower receiver unit of a weapon comprising the steps of:

a. mating a lower receiver unit onto a device comprising:

(i) a platform substantially in the form of a right circular cylinder having a substantially planar cylindrical base section and a contoured top section; wherein the contoured top section is contoured in a three-dimension pattern enabling it to engage with at least one complementary surface portion of a lower receiver unit of a firearm;

(ii) a pistol grip mating region configured to receive a pistol grip of said firearm; and (iii) a roll pin receiving port positioned on said top section; b. causing said roll pin to be ejected from said trigger guard by means of a downward force applied to said roll pin by suitable means; whereby the roll pin receiving port receives the roll pin upon displacement of the roll pin when ejected from the trigger guard.

15. The method of claim 14, wherein said platform comprises a contoured top section comprising at least one each of a cutout, a mating region and a stop region; and a roll pin receiving port;

wherein said cutout is selected from a safety/selector cutout, a magazine release catch cutout, a front trigger guard pivot cutout and a safety lever cutout;

wherein said mating region is selected from a front trigger guard mating region, a trigger guard mating region, a pistol grip mating region and a center lower receiver body mating region; and wherein said stop region is selected from a front trigger guard stop region and an upper lower receiver body stop region.

16. The method of claim 15, wherein said platform comprises a substantially planar cylindrical base section in the form of a right circular cylinder having a contoured top section;

wherein said base section has a substantially flat bottom surface; and wherein said base section mates with a receptive docking region located on a base platform of a weapons servicing and repair station.

* * * * *